United States Patent [19]

Alley

[11] 4,116,306

[45] Sep. 26, 1978

[54] ELEVATOR CAR GENERATOR-MOTOR-BRAKE CONTROL UNIT APPARATUS AND METHOD

[75] Inventor: Don B. Alley, Sacramento, Calif.

[73] Assignee: Elevator Industries, Sacramento, Calif.

[21] Appl. No.: 792,399

[22] Filed: Apr. 29, 1977

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,250,972 | 5/1966 | Morris | 187/29 |
| 3,297,110 | 1/1967 | Bagnasco | 187/29 |
| 3,379,285 | 4/1968 | Leitz | 187/29 |
| 3,741,348 | 6/1973 | Caputo | 187/29 |
| 3,902,572 | 9/1975 | Ostrander | 187/29 |

*Primary Examiner*—Robert K. Schaefer
*Assistant Examiner*—W. E. Duncanson, Jr.
*Attorney, Agent, or Firm*—Flehr, Hohbach, Test, Albritton & Herbert

[57] ABSTRACT

A generator, hoist motor, and hoist motor brake for controlling the drive of an elevator car in a hoistway in accordance with speed and direction inputs. A generator-motor-brake unit is powered by an AC power source and also receives the speed and direction inputs. The speed and direction inputs are converted to elevator car command signals. A master waveform generator receives the AC power signal and provides a precise waveform synchronous with the AC power signal. The precise waveform and command signals are connected to a number of comparator triggers which provide a generator field trigger signal, a motor field trigger signal, and as hoist motor brake trigger signal. The trigger signals are each connected to individual power metering elements connected between the AC power source and each of the generator and motor fields, and the hoist motor brake. Power is thereby metered to the generator field, the motor field, and the hoist motor brake in accordance with the speed and direction inputs. When the generator is driven rotationally and the generator field is excited, the generator produces an output which is connected to the motor winding. The polarity of the generator output dictates the direction of rotation of the motor when the motor field is excited. The hoist motor brake is disengaged by the metered power while the elevator car is in motion and engages the motor shaft to fix the car in position in the hoist way when the motor is stopped.

17 Claims, 8 Drawing Figures

ELEVATOR CAR GENERATOR-MOTOR-BRAKE CONTROL UNIT APPARATUS AND METHOD

BACKGROUND OF THE INVENTION

This invention relates to circuits for controlling a generator, motor, and brake operating in a control system and more particularly to such a control system for use in controlling an elevator car in an elevator hoistway.

In the past, attempts to control power supplied to driving components for an elevator car in a hoistway utilizing duty cycle switching of an AC power signal have been hampered by asymmetry in the power signal, and by difficulty in obtaining a stable reference signal for the triggering necessary to obtain precision in duty cycle regulation. Trigger pulses necessary to obtain long firing angles for low power operation were difficult to obtain with acceptable firing angle accuracy due to reference signal drift. Unfortunately, it is at the long firing angle that greatest trigger signal accuracy is required, since this condition corresponds to the slowest elevator car speeds, which may occur with the elevator doors open. Erratic elevator car operation with passengers embarking or disembarking is clearly undesirable. Moreover, since the usual AC power signal wave is asymmetrical, high speed operation depending upon triggering the postive pulses for one direction of elevator car movement and triggering the negative AC signal pulses for the opposite elevator car movement, have often resulted in unequal speeds of movement in opposite elevator car directions. Prior elevator car drive systems have displayed abrupt increasing and decreasing acceleration characteristics, which may cause some degree of passenger discomfort depending on the running speeds desired to be attained by the elevator car.

There is a need therefore for a control system which responds to speed and direction inputs for driving an elevator car, and which provides equal speeds in the up and down directions, linear increasing and decreasing acceleration of the car, and precise triggering at desired firing angles to obtain close control of elevator car movement over the entire elevator car speed range.

SUMMARY AND OBJECTS OF THE INVENTION

In general the disclosed control system is for a generator, a hoist motor, and a hoist motor brake which function to position an elevator car in an elevator hoistway in response to speed and direction inputs. A master waveform generator is configured to be energized by an AC power source, and provides a ramp waveform which has predetermined initial and terminal ramp levels for each positive and negative half cycle of the AC power signal. A circuit is provided for receiving the speed and direction inputs and for providing an output level command signal in response thereto. A generator field comparator is coupled to the ramp waveform and the output level command signal, providing a generator field trigger signal in accordance with the comparison. A motor field comparator is also coupled to receive the ramp waveform and the output level command signal and to provide a motor field trigger signal in accordance with the comparison. A brake comparator is likewise coupled to the ramp waveform and the output level command signal and provides a hoist motor brake trigger signal in response to comparison therebetween.

A plurality of power metering circuit elements are provided which are connected to the power source signal, and which each receive one of the generator field, motor field, and hoist motor brake trigger signals at a control input thereon. As a consequence, respective ones of the plurality of power metering circuit elements are controlled to pass the power source signal to each of the generator field winding, the motor field winding, and the hoist motor brake actuating coil, as dictated by the speed and direction inputs.

It is an object of the present invention to provide a generator-motor-brake control circuit which provides improved accuracy in elevator car speed control.

Another object of the present invention is to provide a generator-motor-brake control system in which the elevator car controlled speed in an upward direction is substantially the same as the elevator car controlled speed in a downward direction.

Another object of the present invention is to provide a generator-motor-brake control system which provides linear increasing and decreasing acceleration of the elevator car.

Additional objects and features of the invention will appear from the following description in which the preferred embodiment has been set forth in detail in conjunction with the accompanying drawings.

DESCRIPTION OF THE PREFERRED EMBODIMENT

Figure 1:
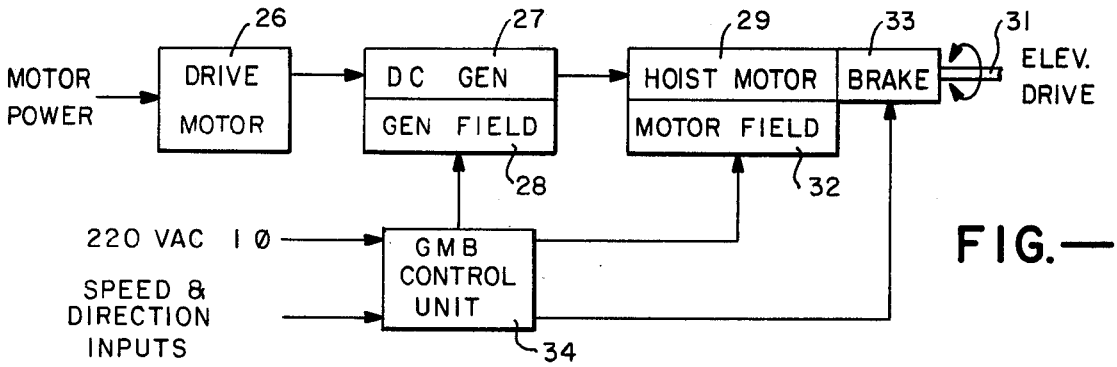
FIG. 1 is a block diagram showing an elevator car control system including a generator-motor-brake control unit.

In the block diagram of FIG. 1 a drive motor 26 is shown receiving motor power and driving a DC generator 27 rotationally. A generator field winding 28 is associated with DC generator 27. Output from DC generator 27 is connected to the winding of a hoist motor 29 which drives an output shaft 31. Output shaft 31 may provide power for driving an elevator car (not shown) in an elevator hoistway. Hoist motor 29 has associated therewith a motor field winding 32 and a hoist motor brake 33, which selectively engages and disengages output shaft 31. Hoist motor brake 33 may be of the type wherein the brake shoe is disengaged from output shaft 31 when an actuating coil in the hoist motor brake 33 is energized, and which contains a brake setting spring urging the brake shoe against the output shaft 31 when the hoist motor brake coil is de-energized. This type of hoist motor brake is well known and is not a part of this invention.

Figure 2:
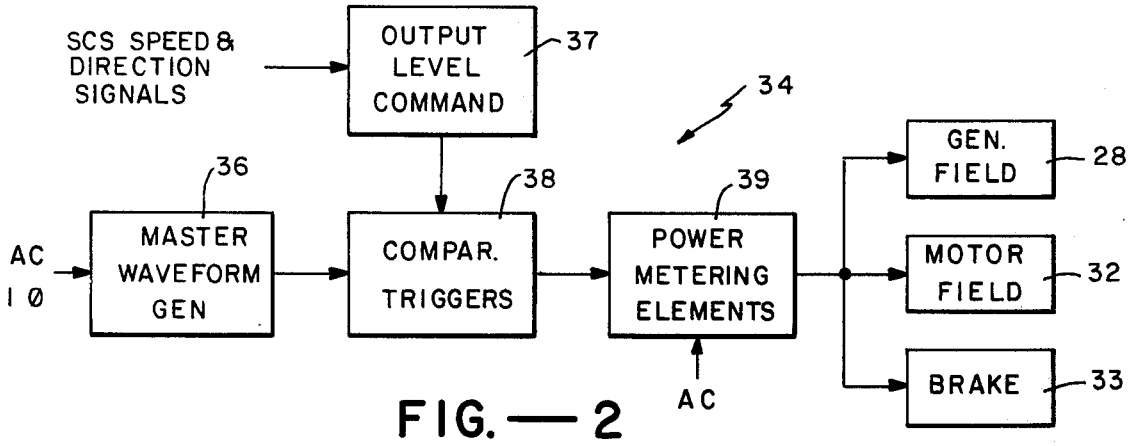
FIG. 2 is a block diagram of the generator-motor-brake control unit of FIG. 1.

A generator-motor-brake control unit 34 is seen in FIG. 1 receiving power from an AC power source, and also receiving speed and direction inputs. FIG. 2 shows the generator-motor-brake (GMB) control unit 34 in which a master waveform generator 36 receives the AC power source signal, and an output level command circuit 37 receives the speed and direction signal inputs. It should be noted here that the speed and direction signal input may be provided by a supervisory control subsystem as disclosed in co-pending patent application, attorney's docket No. A-31376.

The output level command signal and the master waveform generator signal are coupled to comparator triggers 38 which provide a number of trigger outputs to specific power metering elements 29. AC power is provided by duty cycle switching to the generator field 28, the motor field 32, and the hoist motor brake 33.

Figure 3:
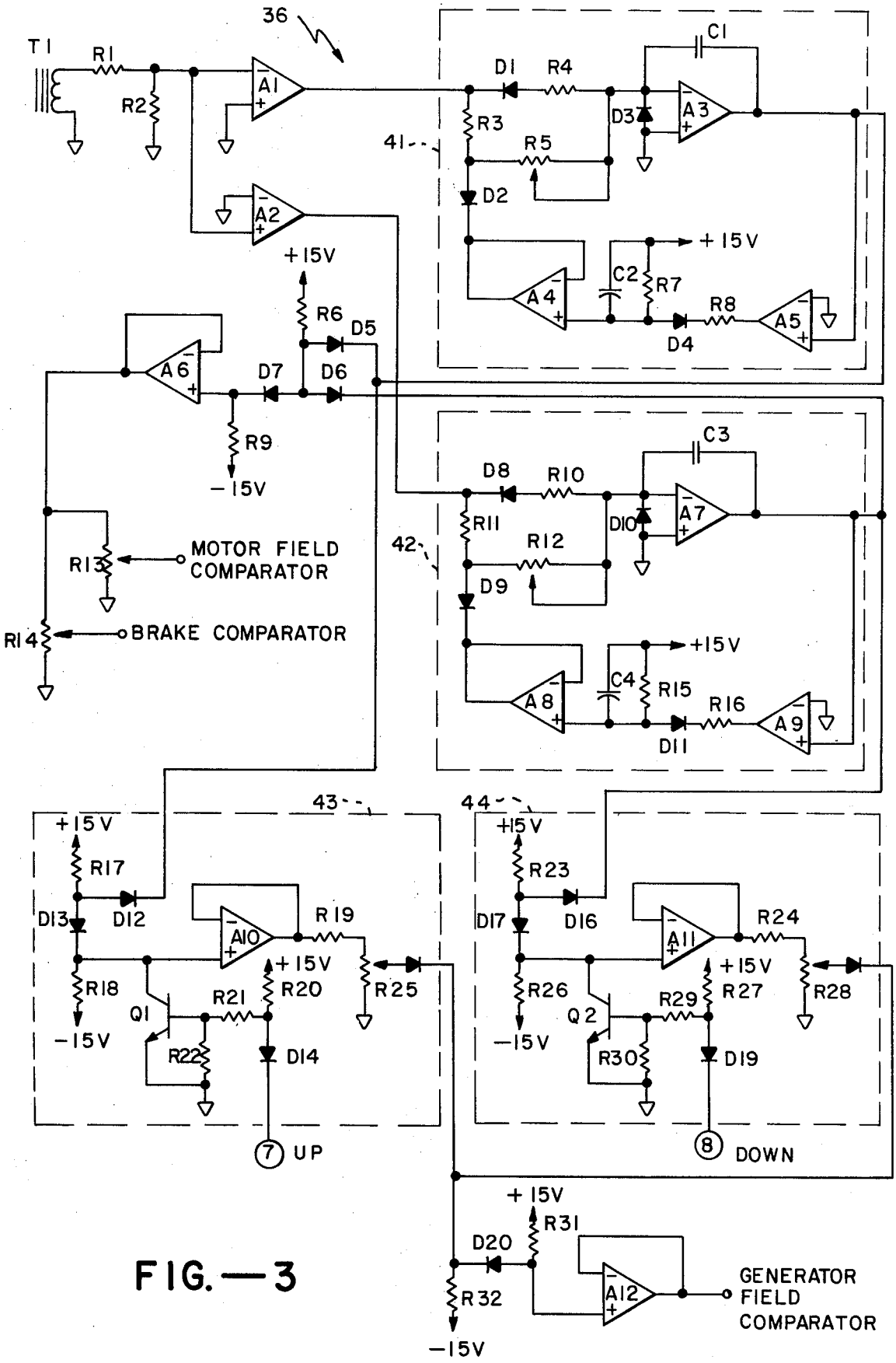
FIG. 3 is an electrical schematic drawing of the master waveform generator.

Turning now to FIG. 3, a schematic diagram of the master waveform generator 36 is seen. A step down transformer T1 provides a low level replica of the AC power wave. The stepped down AC power wave on the secondary of transformer T1 is connected to the inverting input of comparator A1 and the non-inverting input of comparator A2. As a consequence, the outputs of comparators A1 and A2 are 180° out of phase, and are substantially square waves. The output from comparator A1 is coupled to an "up" master ramp generator at the inverting input of amplifier A3 configured as an integrator with feedback capacitor C1. An input circuit including diode D1, resistors R3 and R4, and variable resistors R5 is connected to the inverting input of integrator A3. The negative half cycle of the output of comparator A1 causes a positive output slew from integrator A3 which has a comparatively fast rise time as the signal transits resistor R4 and diode D1. The positive half cycle of the output from comparator A1 causes a negative slew at the output of integrator A3. The positive and negative ramps at the output of integrator A3 are controlled relatively by adjustment of variable resistor R5. The output from integrator A3 is coupled to the non-inverting input of amplifier A5 which produces a negative output for any negative output from integrator A3. A smoothing circuit consisting of capacitor C2 and resistor R7 receives any negative outputs from amplifier A5 and places it on the non-inverting input of amplifier A4. Amplifier A4 is an impedance matching follower driving the cathode of didode D2 downward for negative outputs from amplifier A5. A drop at the inverting input of integrator A3 will prevent further negative slew of the output therefrom, and the negative slewing output from integrator A3 is therefore seen to be captured substantially at a zero voltage level at the zero crossing at the end of each AC power cycle. The output from comparator A2 being 180° out of phase with the output from comparator A1, a down master ramp generator 42 connected thereto may be seen to provide a negatively slewing ramp at the output of amplifier A7 operating as an integrator in conjunction with feedback capacitor C3. The negatively slewing ramp from integrator A7 is displaced 180° in the power cycle from the negatively slewing ramp at the output of integrator A3. A pair of negatively slewing ramps are therefore obtained, synchronized with the AC power signal, and having a terminal end which is forced to a zero reference level.

The up and down master ramp signals from up and down master ramp generators 41 and 42 respectively, are connected through diodes D5, D6 and D7 to the non-inverting input of amplifier A6. The combination of the diodes and amplifier A6 selects the lowest instantaneous DC value in the two ramp signals and therefore produces a sawtooth waveform at the output thereof which contains the negatively slewing up and down master ramp signals. The output from amplifier A6 is coupled through adjustable resistor R13 to a motor field comparator to be hereinafter described, and through an adjustable resistor R14 to a brake comparator to be hereinafter described. Adjustable resistors R13 and R14 are provided so that the input to the indicated comparators may be adjusted in level. The output from up master ramp generator 41 is also coupled to an up generator field comparator input selector 43, and the down master ramp signal from down master ramp generator 42 is connected to a down generator field comparator input selector 44. Up generator field comparator input selector 43 has a terminal 7 thereon, and down generator field comparator input selector 44 has a terminal 8 thereon. Terminals 7 and 8 are provided for up and down directional inputs respectively. By way of example, when no direction input is applied to terminal 7, a high state exists at the base of transistor Q1, placing Q1 in a conducting mode. However, when an up direction input is applied, terminal 7 is pulled down toward zero volts and transistor Q1 is turned off. As a consequence, the up master ramp signal appears at the non-inverting input of follower A10. A variable resistor R25 is provided to adjust the level of the output from follower A10, effectively adjusting the level of the initial end of the negatively slewing up master ramp signal. The adjusted up master ramp signal is coupled to the non-inverting input of follower A12 and provided at the output thereof for coupling to a generator field comparator to be hereinafter described. In like manner if a down direction input is provided at terminal 8 the down master ramp signal is provided at the output of follower A12 to be coupled to the generator field comparator. It should be noted that the down generator field comparator input selector 44 contains a variable resistor R28 which operates to adjust the down master ramp signal level. It may therefore be seen that appropriate adjustment of variable resistor R25 and R28 will afford substantially the same initial up and down master ramp signal levels, thereby providing substantially similar up and down master ramp signals having known initial and terminal levels in spite of asymmetry between positive and negative half cycles of the stepped down AC power signal at the secondary of transformer T1.

Figure 4:
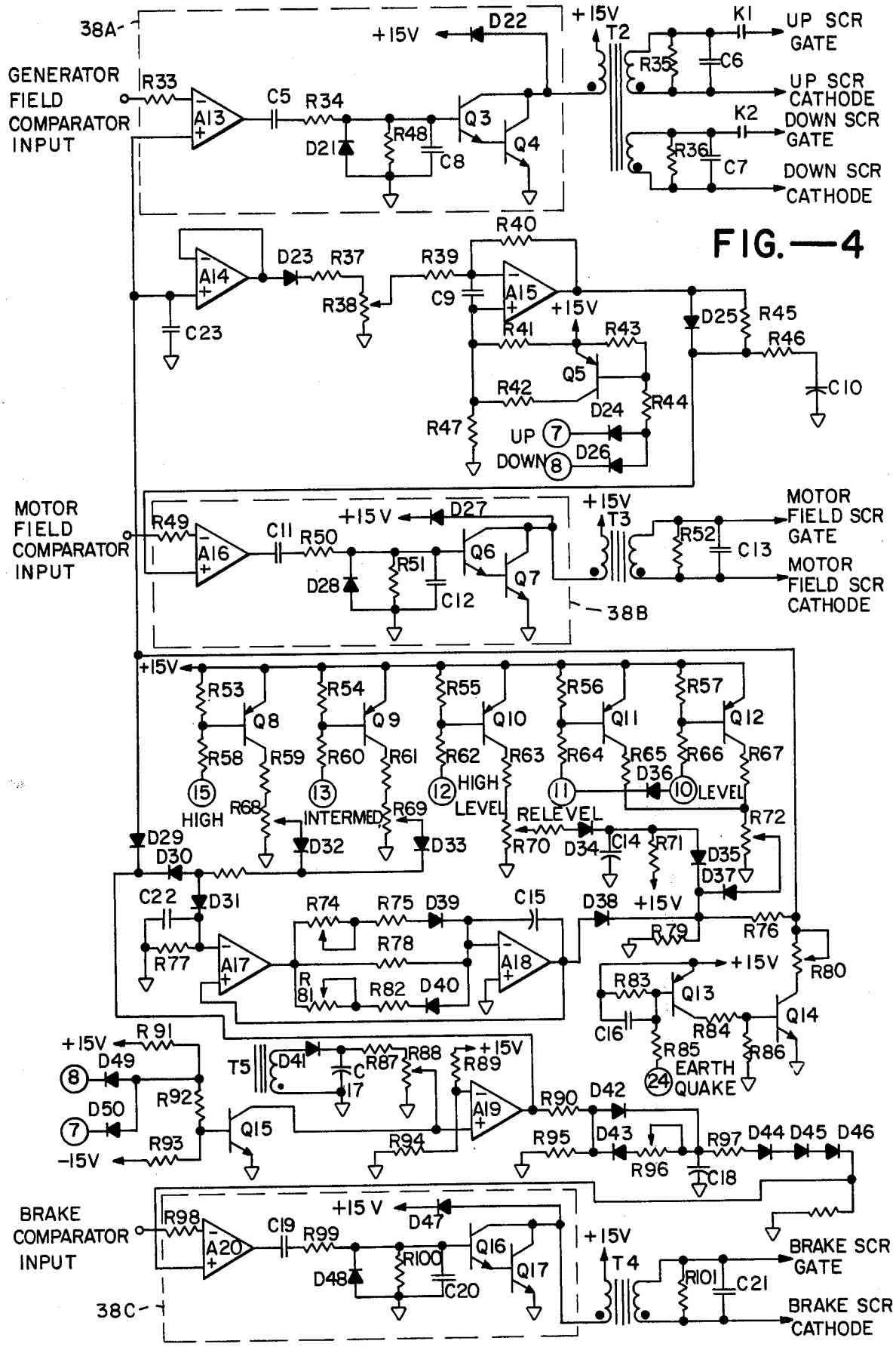
FIG. 4 is an electrical schematic drawing of the comparator triggers and the output level command signal circuit.

Turning now to FIG. 4 a schematic drawing of the output level command circuit 37 and the comparator trigger circuits 38 is shown. The generator field comparator **38*a* is shown receiving the direction selected master ramp waveform at one input to comparator A13. In like fashion the adjusted level combination up and down master ramp signal is shown at one input to comparator A16 in motor field comparator trigger 38*b*, and to one input of comparator A20 in brake comparator trigger 38*c*. A plurality of speed inputs are provided in the output level command circuit portion 37A. Terminal 15 is provided to receive high speed inputs. Terminal 13 is provided to receive intermediate speed inputs. Terminal 12 is provided to receive high leveling speed inputs. Terminal 10 is provided to receive leveling speed inputs. Terminal 11 is provided to receive re-leveling inputs. High leveling speed, releveling speed, and level speed inputs at terminals 12, 11 and 10 respectively pull the respective bases of transistors Q10, Q11** and Q12 down, turning them on. Speed signals are therefore provided which are connected to the node between resistors R79 and R76.

Speed inputs coupled to terminals 15 or 13 turn on transistors Q8 or Q9. Signal level is adjusted for high or intermediate speed inputs at variable resistors R68 or R69. The selected high or intermediate speed input signal levels appear at the inverting input to amplifier A17. The input to amplifier A17 appears as a square pulse as transistors Q8 or Q9 are turned on by the high or intermediate speed inputs, and subsequently turned off. The inverted square output pulse at the output of amplifier A17 is coupled to the inverting input of amplifier A18 operating as an integrator with capacitor C15 in a feedback path between output and input thereon. It may be seen that a positive going pulse at the inverting input of amplifier A17 provides a positive slewing ramp at the output of integrator A18 which stabilizes at a predetermined level. The output of integrator A18 maintains the stabilized level until the square pulse input trailing edge to amplifier A17 falls. At this time the output from integrator A18 begins to slew negatively back to a quiescent level. A variable resistor R81 is provided to adjust the positive slewing slope at the output of integrator A18. A variable resistor R74 is provided to adjust the negative going slope at the output of integrator A18. The adjusted increasing and decreasing acceleration signal from the output of integrator A18 is coupled to the node between resistors R79 and R76, to be there summed with the signal corresponding to the highest speed selected at terminals 10, 11 and 12 as described above. The resulting signal is provided as the output level command signal coupled to the other input of comparator A13 in generator field comparator trigger 38A. When the selected up or down generator field comparator master waveform is compared with the output level command signal so as to provide an output from comparator A13, the Darlington pair consisting of transistors Q3 and Q4 is turned on to provide a trigger pulse in the primary of transformer T2. A corresponding trigger pulse appears in each of the secondaries shown for transformer T2. The same direction signal which selected up or down direction at pins 7 or 8 of FIG. 3, closes contacts K1 and K2 respectively. As a consequence a trigger signal is provided for either the up or the down direction, and coupled to a power metering element indicated as a silicon controlled rectifier in this embodiment, to be hereinafter described.

The output level command signal from the speed input section **37*a* of the output level command circuit 37 is coupled to the non-inverting input of a follower A14 in a motor field select circuit 37B. The output from follower A14 is connected through a variable resistor R38 to the inverting input of an amplifier A15. A positive signal is applied through resistor R41 to the non-inverting input of amplifier A15. This provides a standing comparator input to comparator A16 and motor field comparator trigger 38*b*. The Darlington pair consisting of transistors Q6 and Q7 is thereby urged to produce a trigger output through the primary of transformer T3, which is coupled to the secondary of transformer T3, to thereby provide metering of the AC power signal to the motor field winding 32 to maintain a standing motor field power level. When either an up or a down direction input is applied to terminals 7 or 8 respectively, transistor Q5 is turned on and a more positive signal is provided at the non-inverting input to amplifier A15. It should be noted that terminals 7 and 8 are isolated one from the other by diodes D24 and D26. As a consequence, when a direction input is present a running comparator input is provided to one input of comparator A16, and the motor field trigger pulse is advanced to provide metering of increased motor running power to the motor field winding 32. The output level command signal modifies the output from amplifier A15 coupled to the motor field comparator A16. The output level command signal tends to decrease the metered motor field winding power from the AC source as generator field winding power is increased. The amount of decrease, or "dip", is adjustable at variable resistor R38, the minimum amount of dip occurring when substantially all variable resistor R38 is coupled to the inverting input of amplifier A15. It should be noted that while a running input is being provided by amplifier A15 to motor field trigger 38*b*, capacitor C10 is charged. When the up or down signal is removed from terminals 7 or 8, and transistor Q5 stops conducting, the charge on capacitor C10 will cause the running signal to the input of motor field comparator trigger 38*b*** to gradually decay, and motor field winding power to decay gradually in like manner. The trigger signal for the power metering element for the motor field winding is indicated as a silicon controlled rectifier in this embodiment.

In the event an earthquake signal is applied to terminal 24, transistor Q13 is turned on, biasing transistor Q14 to a conducting condition, thereby providing an output level command signal for causing the elevator car to run in accordance with a predetermined car running schedule for earthquake emergency.

A motor field current sensing transformer T5 is provided to sense motor field current. Sensed motor field current is half wave rectified by diode D41 and smoothed by capacitor C17 and resistor R87. A motor field sensor DC level adjustment is available at the variable resistor R88. A DC level is thereby provided at the non-inverting input of comparator A19. When an up or down direction input is at pin 7 or 8 respectively, transistor Q15 is turned off. As a consequence, comparator A19 acts as an inhibitor of the output level command signal when no direction input is present or when no motor field winding current is flowing. However, if motor field winding current is flowing, the aforementioned DC signal is generated. If a direction input is also selected, transistor Q15 is turned off and the DC motor field current sensing signal is available as an enabling signal at the non-inverting input to comparator A19. When the enabling signal is sufficiently high, comparator A19 provides an output when transistor Q15 is turned off, and the output command level signal is thereby made available through diodes D44, D45 and D46 to the input of comparator A20 in brake comparator trigger 38C. When comparator A19 is not providing an output, the output level command signal input to the generator field comparator A13 is clamped at a low voltage, precluding comparator output and generator field trigger signals. Consequently motor field current must be flowing and a direction input must be selected, or else the generator field winding cannot be excited. There is, therefore, no generator output, and no motor winding excitation.

It follows from the foregoing that when motor field current is flowing and a direction is selected for car motion at terminals 7 or 8, the up level command signal is coupled to one input of comparator A20 in brake comparator trigger 38C and the Darlington pair of transistors Q16 and Q17 provides a trigger pulse to the primary of transformer T4. The secondary of transformer T4 provides the trigger pulse to the power metering element to be hereinafter described, and indicated in this embodiment as a silicon controlled rectifier.

Figure 5:
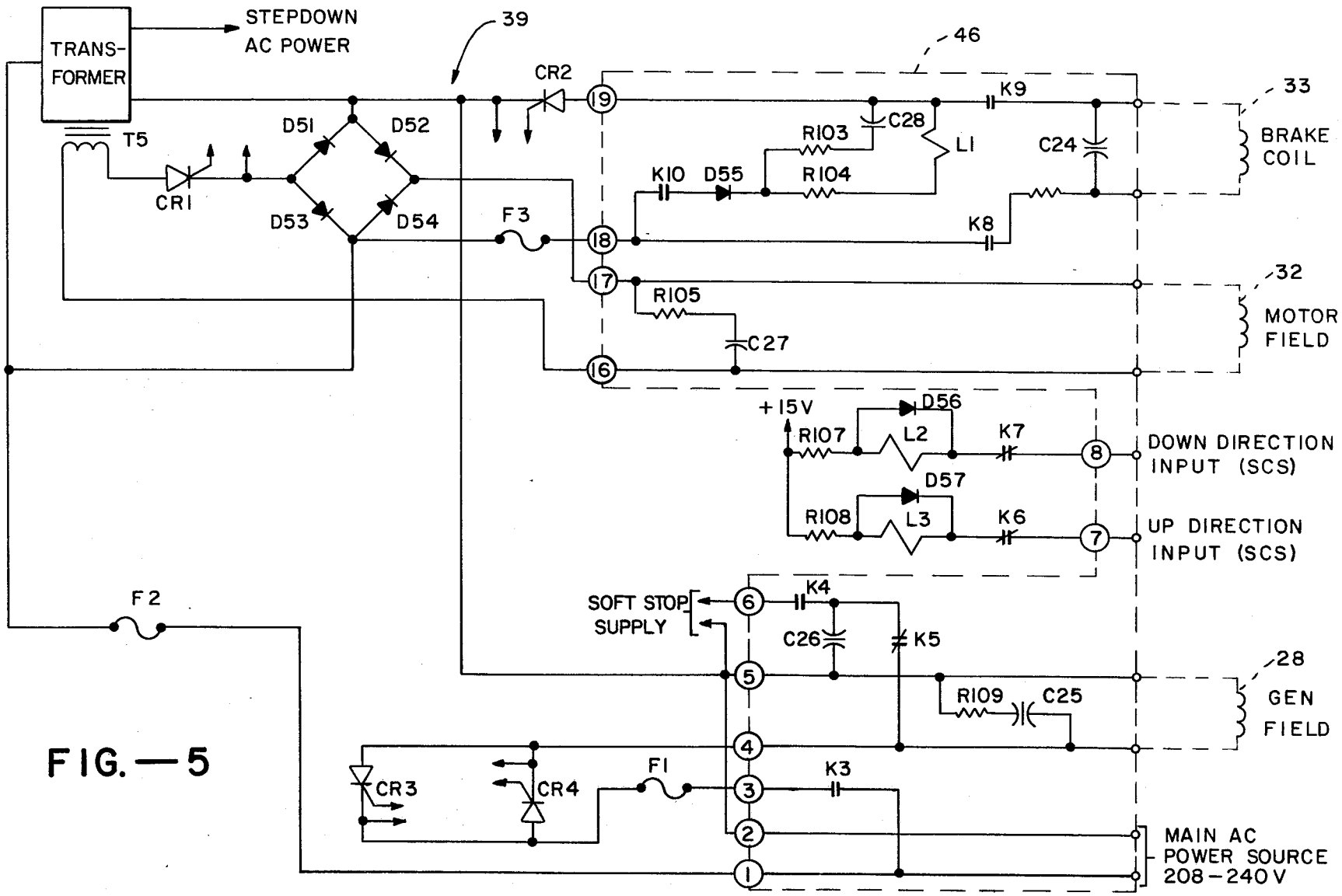
FIG. 5 is an electrical schematic drawing of the generator-motor-brake power metering elements and load circuits.

Turning now to FIG. 5, a schematic diagram is presented showing the relationship between the power metering elements 39, the generator field winding load 28, the motor field winding load 32, the hoist motor brake coil load 33, and load coupling circuits 46 disposed between the loads and the power-metering elements 39. The main AC power source is coupled to the power-metering elements for the generator field winding through normally open contacts K3, terminal 3, and fuse F1. The power-metering elements 39 for the generator field winding are seen as silicon controlled rectifiers (SCR) CR3 and CR4 in parallel opposed connection as seen in FIG. 5. SCR's CR3 and CR4 are connected through terminal 4 to one side of the generator field winding 28. The other side of generator field winding 28 is connected to terminal 5, which is common to terminal 2, and which is coupled to the other side of the main AC power source.

The circuit coupling the power-metering elements 39 to the motor field winding in FIG. 5 is traced as follows. The main AC power source has one side coupled through fule F2 to one input of a full wave rectifying bridge including diodes D51 through D54. The other side of the main AC power source is connected through terminal 2 to the other input of the full wave rectifier bridge. One of the output terminals of the full wave rectifier bridge is connected to terminal 17 which is in turn connected to one side of the motor field winding 32. The other side of the motor field winding 32 is connected to terminal 16, which in turn is connected to the primary of motor field current sensing transformer T5. The anode of a silicon controlled rectifier CR1 is connected to the primary of transformer T5, and the cathode is coupled to the other output terminal on the full wave rectifier bridge. SCR CR1 therefore represents the power metering element 39 for the motor field winding 32. The gate of SCR CR1 is connected to the motor field SCR gate terminal in FIG. 4, and the cathode of SCR CR1 is connected to the motor field SCR cathode terminal in FIG. 4.

The main AC power source is connected through fuse F2, F3, terminal 18, normally open contacts K8, and resistor R106 to one side of the hoist motor brake coil 33. The other side of the brake coil 33 is coupled through normally open contacts K9 through terminal 19 to the anode of SCR CR2. The cathode of CR2 is connected to the other side of the main AC power source through terminal 2. The gate of SCR CR2 is connected to the brake SCR gate terminal on FIG. 4, and the cathode of SCR CR2 is connected to the brake SCR cathode terminal on FIG. 4. In summary, SCR CR1 is duty cycle regulated and serves as the power metering element 39 for the motor field winding 32, SCR's CR3 and CR4 are duty cycle regulated and serve as the power metering elements 39 for the generator field winding 28, and SCR CR2 serves as the power metering element 39 for hoist motor brake coil 33.

Load coupling circuits 46 include load coupling circuits for the brake coil 33, the motor field winding 32, and the generator field winding 28. The load coupling circuit for brake coil 33 is connected between the terminals 18 and 19 and includes contacts K10 which close when the controlled elevator car receives a command to move in the hoistway. A relay coil L1 for normally open contacts K9 and K8 is energized by closure of contacts K10, thereby closing normally open contacts K9 and K8 to couple hoist motor brake coil 33 to its power metering element CR2. Contacts K8 and K9 therefore serve a safety function, closing only when the elevator car is commanded to run in the hoistway. The brake will therefore be set until such a run command is given. Further, contacts K8 and K9 are delayed in opening after contacts K10 open when the elevator car stops, thereby allowing time for the car to be electrically stopped prior to being mechanically stopped by the setting of the brake.

The load coupling circuit for the motor field winding 32 includes resistor R105 and capacitor C27 across the motor field winding. This RC combination serves to smooth the full wave rectified main AC power signal to the motor field.

The load coupling circuit for the generator field winding includes normally closed contacts K5 and normally open contacts K4, together with normally open contacts K3. A capacitor C26 is provided which charges while the generator field winding is energized and contacts K5 are open and K4 are closed. Capacitor C26 provides an electrical soft stop signal for the elevator car, which tends to brake the elevator car electrically. An RC circuit including resistor R109 and capacitor C25 is connected across the generator field winding 28 to smooth the metered main AC power signal thereto.

A circuit is provided which is connected to up and down direction input terminals 7 and 8 and which operates to actuate contacts K1 and K2 of FIG. 4. For example, a down direction input to terminal 8 applies a low level signal through contacts K7, relay coil L2, and resistor R107 to a positive supply voltage. Relay coil L2 is therefore energized closing normally open contacts K2 in FIG. 4. Application of an up direction signal to terminal 7 operates through normally closed contacts K6, relay coil L3 and resistor R108 in like manner to close contacts K1 in FIG. 4.

Figure 6:
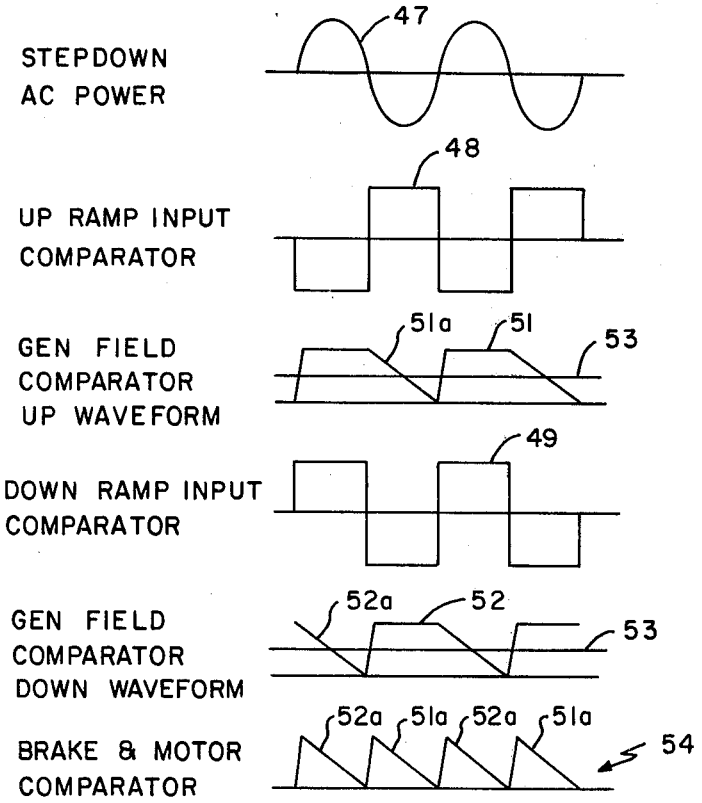
FIG. 6 is a timing diagram showing the waveform generated by the circuit of FIG. 3.

By way of explaining some of the functional characteristics of the system disclosed herein, reference is made to FIG. 6 in the drawings. The manner in which the up and down master ramp waveforms are generated is shown in FIG. 6. The stepped down AC power signal at the secondary of transformer T1 in FIG. 3 is seen at 47. The stepped down AC signal 47 in a sine wave type signal, wherein positive and negative half cycles may not be symmetrical about the zero reference point. The output from comparator A1 in FIG. 3 is seen to be the square wave 48 of FIG. 6. The output from caparitor A2 of FIG. 3 is seen to be the square wave 49 of FIG. 6. An up master ramp waveform 51 is obtained at the output of up master ramp generator 41 in response to the integrated square wave 48. A down master ramp wave form 52 is obtained from the output of down master ramp generator 42 in response to the integrated square wave 49. The terminal ends of the ramps 51A on the up waveform and 52A on the down waveform are held at a predetermined reference level by the feedback path including follower amplifier A5 and A4 in up master ramp generator 41, and follower amplifiers A9 and A8 in down master ramp generator 42. Both master ramp waveforms 51 and 52, have rapidly slewing positive slopes adjusted by adjustable resistors R5 and R12 of FIG. 3 respectively. The fact portion of the master ramp waveforms 51 and 52 is obtained by saturation of integrators A3 and A7 respectively. As a consequence, knowing the initial and terminal levels os ramps 51A and 52A, a DC signal 53 may be adjusted in level to intersect ramps 51A and 52A at any desirable point during each of the one-half cycles during which they exist. It should be noted that ramps 51A and 52A are displaced by 180 electrical degrees. When up and down waveforms 51 and 52 are combined in the diode network containing the diodes D5 through D7 and amplifier A6, the sawtoothed waveform 53 is obtained alternately containing ramps 51A and 52A.

Figure 7:
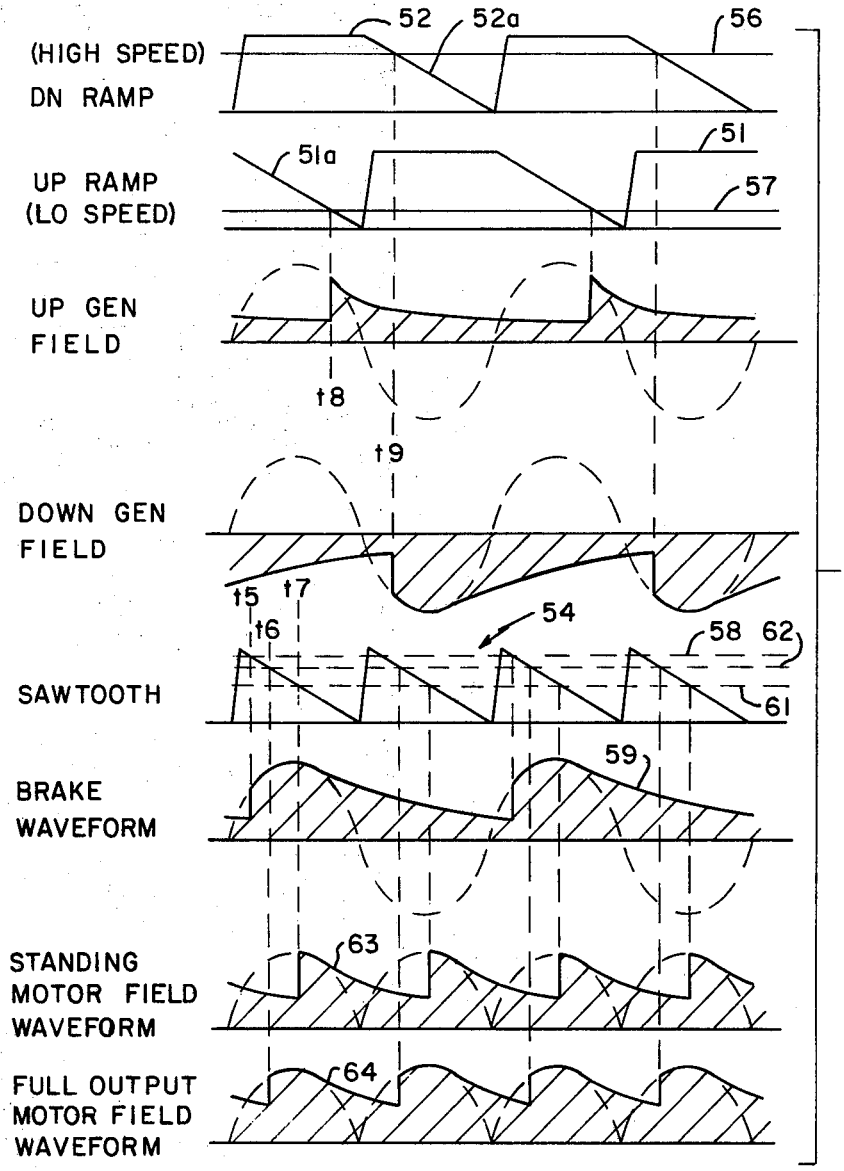
FIG. 7 is a timing diagram showing some of the signals that are generated by the circuits of FIGS. 4 and 5.

Referring now to the timing diagram of FIG. 7, the manner in which the master ramp signals are utilized to meter the AC power signal is shown. Up and down master ramps 51A and 52A are adjusted at the initial end by means of the variable resistors R25 and R28 respectively of FIG. 3 as hereinbefore described. As a consequence, asymmetry between positive and negative cycles of the stepped down AC power signal 47 is compensated. The inputs to the generator field comparator trigger 38A are seen in FIG. 7 as waveform 52 together with an output level command signal 56, providing a high down speed, for example, and master ramp waveform 51 together with lower output level command signal 57, providing a low up speed, for example. Output level command signals 56 and 57 are shown in FIG. 7 as instantaneous DC level signals. It is to be understood that the output level command signals are controlled at certain times to increase or decrease at predetermined rates, as explained in the disclosure of the increasing and decreasing acceleration signals generated by the circuitry of FIG. 4 for example.

Variation of the level of output level command signal 57 will clearly vary the firing angle at SCR CR4 in FIG. 5. The intersection of ramp 51A and output level command signal 57 provides a firing angle at time *t*8. The comparison between ramp 52A and output level command signal 56 provides a trigger signal at SCR CR 3 of FIG. 5 which produces a firing angle represented by time *t*9. The AC power waveform is represented by the dashed sine waves throughout FIG. 7. It should be noted that the up and down generator field polarities are reversed for up and down elevator car running.

Saw-toothed waveform 54 is coupled to one of the inputs of brake comparator trigger 38C as hereinbefore described, as is an output level command signal 58. Intersection of output level command signal 58 with one of the ramps of saw-toothed waveform 54 produces a brake trigger signal. The brake trigger signal is shown occurring at time *t*5, firing SCR CR2, which half-wave rectifies the AC power source signal. Consequently, another firing does not occur until a full AC power source signal cycle later, as shown. A smoothed brake waveform signal 59 is therefore metered to hoist motor brake coil 33.

AC power source signal being full wave rectified by the bridge containing diodes D51 through D54 of FIG. 5, SCR CR1 is fired by the trigger signal provided from the comparison of saw-toothed waveform 54 and a standing motor field output level command signal 61. The trigger signal at SCR CR1 for standing motor field current occurs at time *t*7, where output level command signal 61 intersects each ramp of saw-toothed waveform 54. When increased motor field current is desired, an increased motor field output level command signal 62 is provided at the input to motor field comparator trigger 38B, and SCR CR1 is fired at a shorter firing angle, occurring at the time *t*6. Standing motor field waveform 63 may be seen to provide less power to the motor field winding 32 than full output motor field waveform 64 in FIG. 7.

Figure 8:
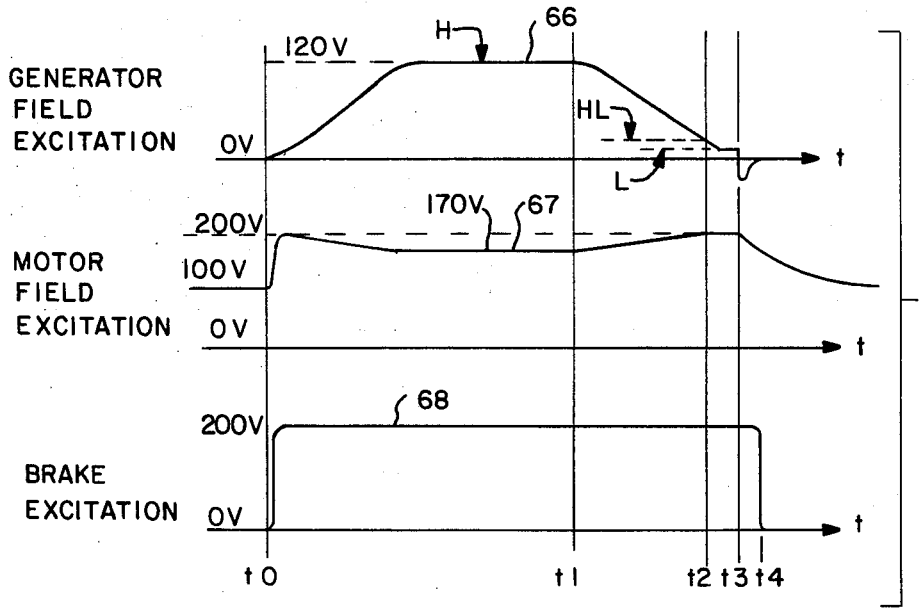
FIG. 8 is a timing diagram showing a typical set of voltage applied to the loads of FIG. 5.

Referring now to FIG. 8, a timing diagram is shown which depicts the load voltages at the generator field winding 28, motor field winding 32, and hoist motor brake coil 33. At the time *t*0, the elevator car is standing idle at a floor landing, and is energized up or down and given a high speed input. A generator field excitation level 66 is shown having an initial upward slope controlled by the acceleration rate control variable resistor R81 of FIG. 4. Generator field excitation levels out as the car attains high speed. The high speed input is dropped at time *t*1, and high leveling speed is selected. The generator field excitation is caused to decrease as controlled by the decreasing acceleration control variable resistor R74 of FIG. 4. At time *t*2 high leveling speed is dropped and level speed is selected. AT time *t*3 all inputs, speed and direction, are dropped and a reverse pulse is seen providing electrical or soft stop. Soft stop is obtained from the stored energy on capacitor C26 of FIG. 5.

FIG. 8 also shows the motor field excitation signal 67 during an elevator car run, where a standing motor file excitation value of 100 volts, for example, is on the motor field winding 32 at time *t*0. Motor field excitation 67 is increased to obtain running speed immediately afer time *t*0, thereafter "dips", or drops, a predetermined amount as determined by the setting on variable resistor R38 of FIG. 4. The amount of weakening is inversely proportional to the generator field excitation level 66 when a direction input for the elevator car is energized. At time *t*1 the motor field excitation 67 begins to rise again to the high value which it reaches at time *t*2. At time *t*3 the motor field excitation curve 67 gradually decays to the standing value as seen at the trailing end of curve 67. The gradually decaying characteristic after time *t*3 in FIG. 8 for motor field level 67 is obtained from the stored energy on capacitor C10 of FIG. 4 as explained hereinbefore.

FIG. 8 also shows a brake excitation level 68, which is zero with the brake set at time *t*0. Immediately after *t*0 brake excitation 68 rises to an average value sufficient to lift the brake against spring pressure which serves to hold the brake on when hoist motor brake coil 33 is de-energized. Brake excitation level 68 is maintained at a relatively constant level until time *t*4, at which time hoist motor brake coil 33 is de-energized and the brake is reset by spring force. The time between times *t*3 ad *t*4 is a delay imposed in de-energizing the hoist motor brake coil 33. This brake resetting delay is provided to allow the elevator car to be stopped electrically by the soft stop feature prior to engagement of the mechanical brake. The delay is imposed by variable resistor R96 and capacitor C18 of FIG. 4, and may be adjusted to some extent by adjustment of variable resistor R96.

A generator-motor-brake control system has been disclosed which provides improved elevator car speed control accuracy, equal up and down elevator car speeds, and linear elevator car acceleration changes.

What is claimed is:

1. A control system for a generator, a hoist motor, and a hoist motor brake, which function to position an elevator car in an elevator hoistway in response to speed and direction inputs, the generator having a generator field winding and a driver, the hoist motor having a motor field winding and an output shaft coupled to drive the elevator car in the hoistway, and the hoist motor brake having an actuating coil operating to control engagement of the brake with the hoist motor output shaft, the system being energized by an alternating power source signal, comprising a master waveform generator coupled to the power source signal and providing a predetermined ramp waveform having predetermined initial and terminal levels, means for providing an output level command signal in response to the speed and direction inputs, a generator field comparator coupled to said predetermined ramp waveform and said output level command signal and providing a generator field trigger signal in response to comparison therebetween, a motor field comparator coupled to said predetermined ramp waveform and said output level command signal and providing a motor field trigger signal in response to comparison therebetween, a brake comparator coupled to said predetermined ramp waveform and said output level command signal and providing a hoist motor brake trigger signal in response to comparison therebetween, and a plurality of power metering circuit elements coupled to the power source signal and each receiving one of said generator field, motor field, and hoist motor brake trigger signals at a control input thereon, whereby respective ones of said plurality of power metering circuit elements are duty cycle controlled to pass the power source signal to energize the generator field winding, the motor field winding, and the hoist motor brake actuating coil in accordance with the speed and direction inputs.

2. A control system as in claim 1 wherein said master waveform generator comprises first and second ramp generators providing first and second ramp output signals synchronous with the power source signal and having substantially opposite phase relation, said first and second ramp generators each including an integrator and a feedback path between the output and input of said integrator operating to drive the terminal end of said first and second ramps to said predetermined terminal level.

3. A control system as in claim 1 wherein said master waveform generator comprises first and second ramp generators providing first and second ramp output signals synchronous with the power source signal and having substantially opposite phase relation, and means for adjusting said first and second ramp output signals to obtain substantially the same predetermined initial levels, whereby asymmetry between positive and negative portions of the power source signal is compensated, so that said generator field winding receives substantially the same power during the positive and negative portions of the power source signal for equivalent speed and up and down direction inputs.

4. A control system as in claim 2 wherein said first and second ramp generators each include means for adjusting the slope of said first and second ramp output signals.

5. A control system as in claim 1 wherein said means for providing an output level command signal comprises circuit means receiving the speed inputs for providing respective speed signals corresponding thereto, an acceleration ramp generator receiving ones of said speed signals and providing a linearly increasing acceleration signal at the initiation of said speed signals and a linearly decreasing acceleration signal at the termination thereof, whereby the elevator car acceleration is increased and decreased linearly.

6. A control system as in claim 5 together with means for independently adjusting the slopes of said linearly increasing and decreasing acceleration signals, whereby the elevator car increasing and decreasing acceleration is adjusted.

7. A control system as in claim 5 together with a motor field selection circuit connected to receive other ones of said speed signals, said increasing and decreasing acceleration signals, and the direction inputs, said motor field selection circuit providing a standing value of output level command signal to said motor field comparator in the absence of speed and acceleration signals, and direction inputs, and a running value of output level command signal to said motor field comparator when said speed and acceleration signals and direction inputs are present.

8. A control system as in claim 5 together with means for sensing motor field current and for providing an enabling signal when the motor field winding is energized, and means for inhibiting said output level command signal at said generator field comparator and said brake comparator, said last named means being connected to receive other ones of said speed signals, said acceleration signals, said enabling signal, and the direction inputs, and operating in the absence of direction inputs and in the absence of said enabling signal, whereby the generator winding field and brake actuating coil are energized in response to said output level command signal when a direction input and motor field current are present.

9. A system operating in conjunction with an alternating power source signal and controlling a generator, motor, and motor brake in accordance with speed and direction inputs, the generator having a generator field winding and providing a generator output when the generator field winding is excited and the generator is driven rotationally, the motor having a motor winding coupled to receive the generator output and a motor field winding and providing a motor shaft torque when the motor and motor field are adequately energized, the motor brake having a coil operating to control engagement of the motor brake with the motor shaft, comprising a master waveform generator providing first and second ramp signals having terminal ends at substantially a common reference level, and being synchronous with the alternating power source signal and substantially 180° out of phase, means for providing an output level command signal in response to the speed inputs, means connected to said master waveform generator for adjusting the initial ends of said first and second ramps to substantially the same level and for providing one of said first and second adjusted ramp signals at an output therefrom in response to the direction inputs, a generator field comparator receiving said one of said first and second ramp signals and said output level command signal and providing a generator field trigger signal at a firing angle within the alternating power source signal cycle determined by said output level command signal, a motor field selection circuit receiving said output level command signal and providing a motor running output level command signal in response thereto, a motor field comparator receiving said first and second ramp signals and said motor running output level command signal and providing a motor field trigger signal at a firing angle within the alternating power source signal cycle determined by said motor running output level command signal, a brake comparator coupled to said output level command signal and said first and second ramp signals and providing a brake trigger signal at a firing angle within the alternating power source signal cycle determined by said output level command signal, a generator field power metering element connected to the alternating power source signal and the generator field winding and having a control terminal connected to said generator field trigger signal, whereby generator field power is determined by said generator field comparator firing angle, a motor field power metering element connected to the alternating power source signal and the motor field winding and having a control terminal connected to said motor field trigger signal, whereby motor field power is determined by said motor field comparator firing angle, a brake power metering element connected to the alternating power source signal and the motor brake coil and having a control terminal connected to said brake trigger signal, whereby motor brake coil power is determined by said brake comparator firing angle.

10. A system as in claim 9 together with means for sending motor field current and providing an enabling signal when motor field current is above a predetermined level, means receiving said enabling signal and said direction inputs for inhibiting said output level command signal in the absence of direction inputs and in the absence of said enabling signal.

11. A system as in claim 9 wherein said means for providing an output level command signal comprises circuit means receiving the speed inputs for providing respective speed signals corresponding thereto, an acceleration ramp generator receiving ones of said speed signals and providing a linearly increasing speed signal at the initiation thereof and a linearly decreasing speed signal at the termination thereof, whereby motor increasing and decreasing speed is linear.

12. A system as in claim 11 together with means for independently adjusting the slopes of said increasing and decreasing speed signals.

13. A system as in claim 9 wherein said master waveform generator comprises first and second comparators receiving the alternating power source signal and providing first and second square wave outputs respectively being substantially of opposite phase, first and second integrators receiving said first and second square wave outputs respectively and providing first and second respective ramp outputs substantially 180° out of phase, first and second feedback circuits connected between the outputs and inputs of said first and second integrators respectively operating to drive the terminal ends of said first and second ramp outputs to said common reference level.

14. A system as in claim 13 together with first and second input circuits connected between said first and second comparators and said first and second integrators respectively, an adjustable element in each of said first and second input circuits operating to control the relative positive and negative slopes in said first and second ramp outputs.

15. The method of controlling a generator, hoist motor, and hoist motor brake, used in driving an elevator car in an elevator hoistway, in accordance with speed and direction inputs, where the generator is driven rotationally and has a generator field winding, the hoist motor has a motor winding and a motor field winding, the hoist motor brake has a coil controlling engagement of the brake with the motor shaft, and utilizing an alternating power source signal comprising the steps of generating a ramp signal during each half cycle of and synchronized with the alternating power source signal, forcing the terminal ends of adjacent ramp signals to a common reference level, adjusting the initial ends of adjacent ramp signals to a predetermined level, generating an output level command signal corresponding to the speed inputs, comparing one of the sets of alternate ramp signals corresponding to the direction inputs with the output level command signal to obtain a generator field trigger signal, metering the alternating power source signal to the generator field winding with the generator field trigger signal, whereby the generator produces an output, connecting the generator output to the motor winding, gating the output level command signal with the direction inputs, comparing the gated output level command signal with the ramp signal to obtain a motor field trigger signal, metering the alternating power source signal to the motor field winding with the motor field trigger signal, whereby the motor is driven directionally in accordance with the generator output polarity, sensing motor field current, inhibiting the output level command signal in the absence of the direction inputs or sensed motor field current, passing the output level command signal with the direction inputs and the sensed motor field current, comparing the passed output level command signal with the ramp signal to obtain a brake trigger signal, metering the alternating power source signal to the hoist motor brake coil, whereby the hoist motor brake is set when the output level command signal is inhibited.

16. The method of claim 15 wherein the step of generating an output command signal comprises the steps of generating a speed pulse signal corresponding to the speed inputs, integrating ones of the speed pulse signals to obtain a linear acceleration increase following initiation of the speed pulse and a linear acceleration decrease following termination of the speed pulse, and summing the integrated speed pulse signals with the other ones of the speed pulse signals.

17. The method of claim 15 together with the steps of reversing the generating field winding polarity immediately prior to reaching the elevator car destination, thereby stopping the elevator car electrically, and delaying hoist motor brake setting until after the elevator car is stopped.

* * * * *